US005664350A

United States Patent [19]

Moore, III

[11] Patent Number: 5,664,350

[45] Date of Patent: Sep. 9, 1997

[54] HOOP PRESS WITH PIVOTING PLATENS AND METHOD

[76] Inventor: E. Frank Moore, III, 8013 Walker Mill Rd., Randleman, N.C. 27317

[21] Appl. No.: 706,245

[22] Filed: Sep. 4, 1996

[51] Int. Cl.[6] ..... D06C 3/08

[52] U.S. Cl. ..... 38/102.2

[58] Field of Search ..... 38/102, 102.2, 38/102.91; 269/303, 900, 903, 909; 101/127.1; 160/180; 100/202, 210

[56] References Cited

U.S. PATENT DOCUMENTS

| | | | |
|---|---|---|---|
| 3,664,288 | 5/1972 | Von Boden et al. | 112/103 |
| 4,561,177 | 12/1985 | Rancer . | |
| 4,644,629 | 2/1987 | Moore . | |
| 4,981,092 | 1/1991 | Bauman et al. | 112/103 |
| 5,590,613 | 1/1997 | Head | 38/102.2 X |

OTHER PUBLICATIONS

Tajima Industries, Ltd., TFS-30 Frame Setter; Japanese Advertisement.

Drawings from pending design patent application Serial No. 29/044,792 filed 08 Sep. 1995.

*Primary Examiner*—Ismael Izaguirre

[57] ABSTRACT

An embroidery hoop press and method of operation permit the user to frame large areas of thick fabric between inner and outer embroidery hoops by the use of relatively little pressure. The mechanical press includes an upper platen for retaining the inner fabric hoop which is movable in an arcuate path downwardly to allow the hoops to initially contact an angle of approximately 10°. With continued downward force the press gradually causes the inner and outer fabric hoops to fully engage as the lower platen simultaneously pivots. A dampener attached to the upper platen allows the operator to quickly release the handle without injury or vibration.

15 Claims, 6 Drawing Sheets

HOOP PRESS WITH PIVOTING PLATENS AND METHOD

BACKGROUND OF THE INVENTION

1. Field of the Invention

The invention herein pertains to mechanical hoop presses as are used in the embroidering and sewing industry to frame fabrics such as the backs of garments and pertains particularly to manually operated presses and methods for such purposes.

1. Description of the Prior Art and Objectives of the Invention

In order to stitch or embroider specific garment areas with accuracy, the particular area of fabric such as a part of the front or back of a shirt or jacket must be "framed" by tightly sandwiching the fabric between conventional inner and outer fabric hoops. Originally such framing was done by hand, however, as bigger surface areas were needed, mechanical presses became commonplace due to the difficulty and force required to urge such hoops into engagement, particularly when using heavy fabrics. Such mechanical presses generally urge the inner fabric hoop and fabric into the outer fabric hoop by forcing an axially aligned inner fabric hoop into an outer fabric hoop which has first been covered with the selected fabric. Thus, the inner fabric hoop makes substantially 360° initial contact with the outer fabric hoop and is forced axially therein by the use of high pressure provided by the mechanical press.

When framing by hand, the outer fabric hoop is covered with fabric and the inner fabric hoop is then placed against the fabric with the inner fabric hoop at an angle of about 10°–30° to the outer fabric hoop during initial contact. Next, the inner fabric hoop is urged into horizontal alignment with the outer fabric hoop by gradually reducing the angle to 0° and the two hoops fully engage. Thus, this gradual process of engagement requires the use of less force than would be needed for initial 360° engagement as usually occurs with mechanical presses. As larger areas and heavier fabrics are now being embroidered, more speed and force is required in the hand framing operation which places a greater burden and effort on the fabric framers.

Thus, with the disadvantages and problems associated with prior framing methods and devices, the present invention was conceived and one of its objectives is to provide a mechanical hoop press and method for easy, convenient, manual operation.

It is another objective of the present invention to provide a hoop press whereby the upper platen containing the inner fabric hoop angularly moves into engagement with the cloth and outer fabric hoop on a lower pivotal platen.

It is yet another objective of the present invention to provide a hoop press which can be easily operated by relatively unskilled workers without undue strain or physical exertion even with relatively large hoops.

It is still another objection of the present invention to provide a hoop press and method which allows the upper platen to pivotally engage the lower platen and then permits both platens to pivot for full hoop engagement.

It is also another objective of the present invention to provide a hoop press and method which mechanically simulates the prior manual fabric framing steps.

It is a further objective of the present invention to provide a hoop press which includes a dampener which allows the operator to release the upper platen handle immediately upon full engagement of the inner and outer fabric hoops.

Various other objectives and advantages of the present invention will become apparent to those skilled in the art as a more detailed description is set forth below.

SUMMARY OF THE INVENTION

The aforesaid and other objectives are realized by providing a manually operated mechanical hoop press which includes an upper pivotal platen for retaining an inner fabric hoop and a lower pivotal platen which retains the outer fabric hoop. The inner fabric hoop is so positioned whereby its initial engagement with the outer fabric hoop will be at an angle of approximately 10° from the horizontal position of the outer fabric hoop. Once initial contact between the hoops and fabric is made, continual downward movement of the upper platen will cause the lower platen to slightly pivot simultaneously with the upper platen, whereby the inner and outer fabric hoops will gradually and fully engage with only usual manual force employed by the press operator. Once full engagement has been achieved, the operator can release the handle attached to the upper platen and a dampener will control the upper platen's rise as the press returns to a fully opened position. The operator can then remove the framed fabric (with hoops) and reload the upper and lower platens with new hoops and fabric so the framing cycle can be repeated.

DETAILED DESCRIPTION OF THE PREFERRED EMBODIMENTS AND OPERATION OF THE INVENTION

Figure 1:
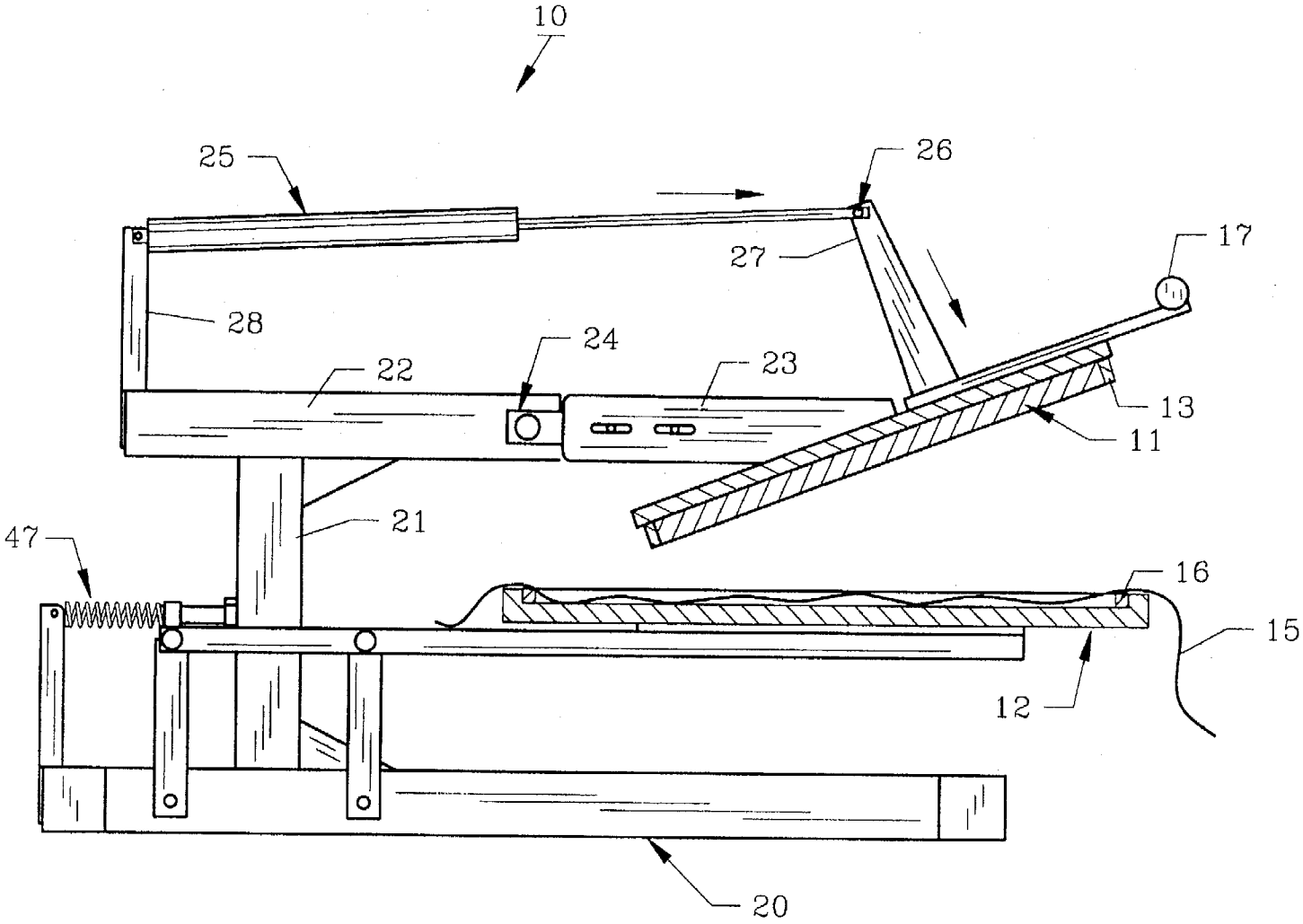
FIG. 1 shows a side elevational view of the hoop press of the invention with the upper and lower platens and hoops before contact and seen in cross-section for clarity.
Figure 4:
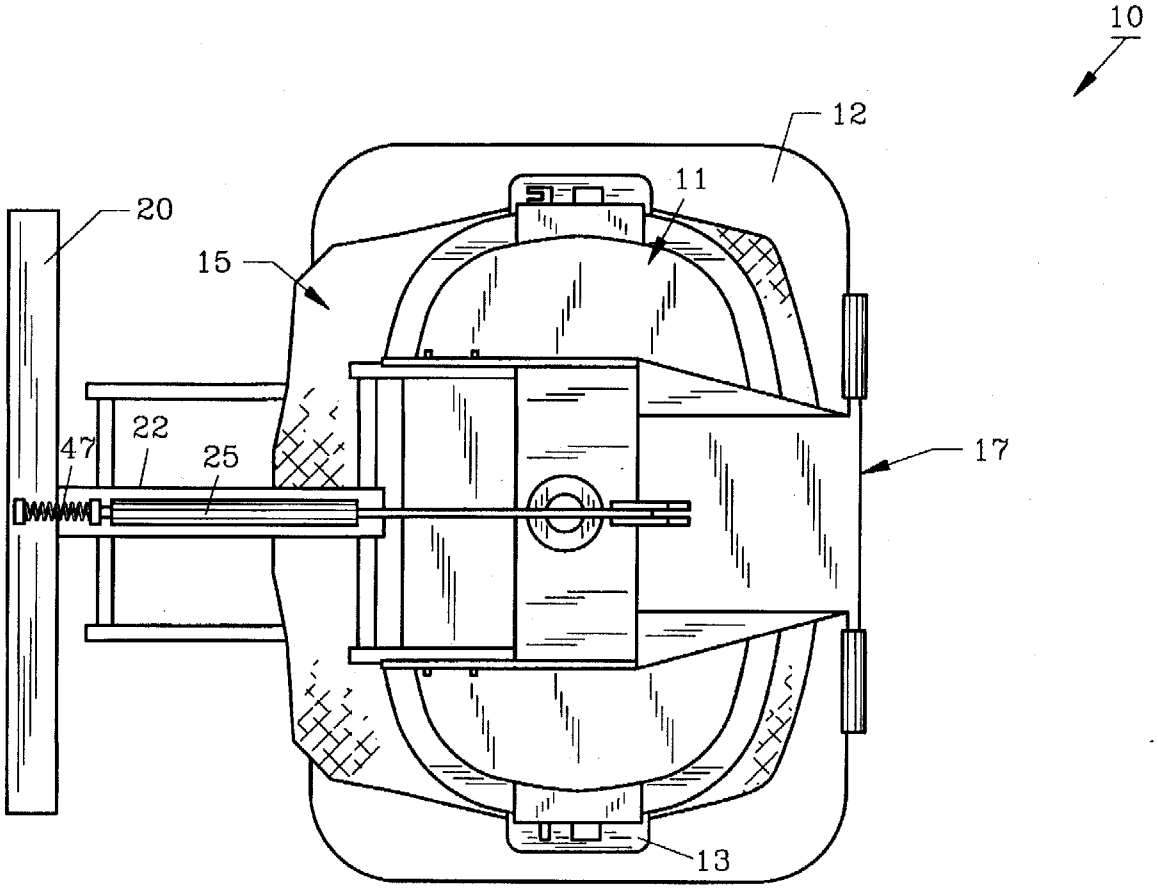
FIG. 4 depicts a top plan view of the hoop press as shown in FIG. 3.
Figure 5:
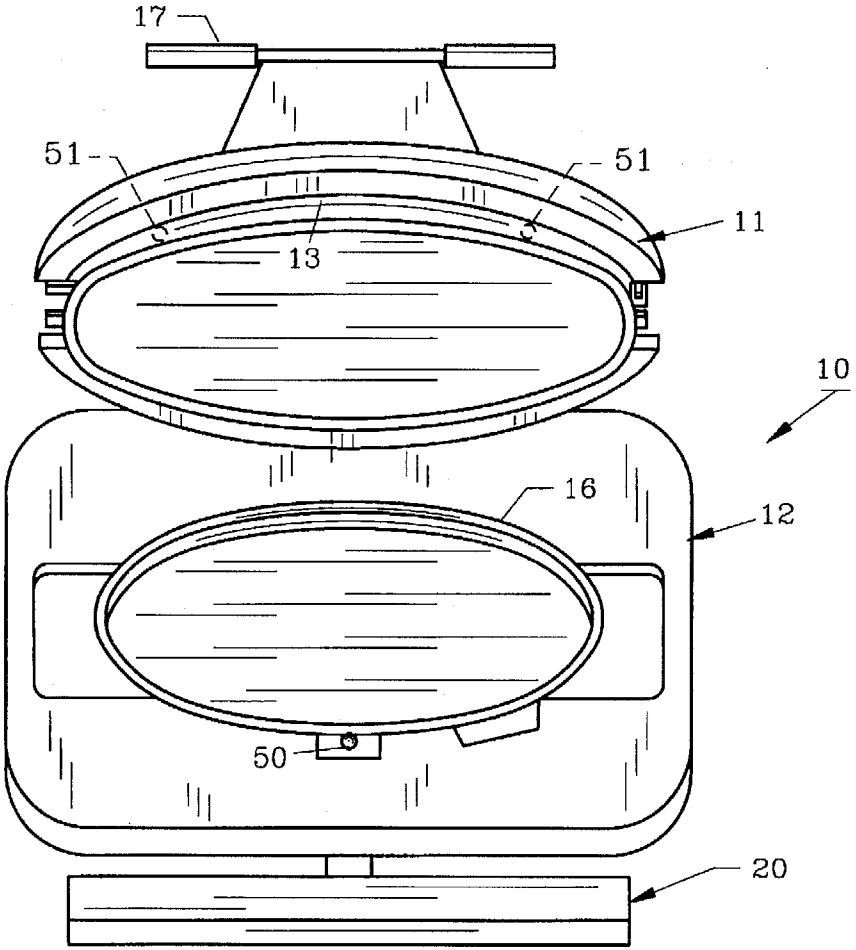
FIG. 5 pictures a front elevational view of the hoop press as seen in FIG. 1 with the press fully opened without fabric.
Figure 6:
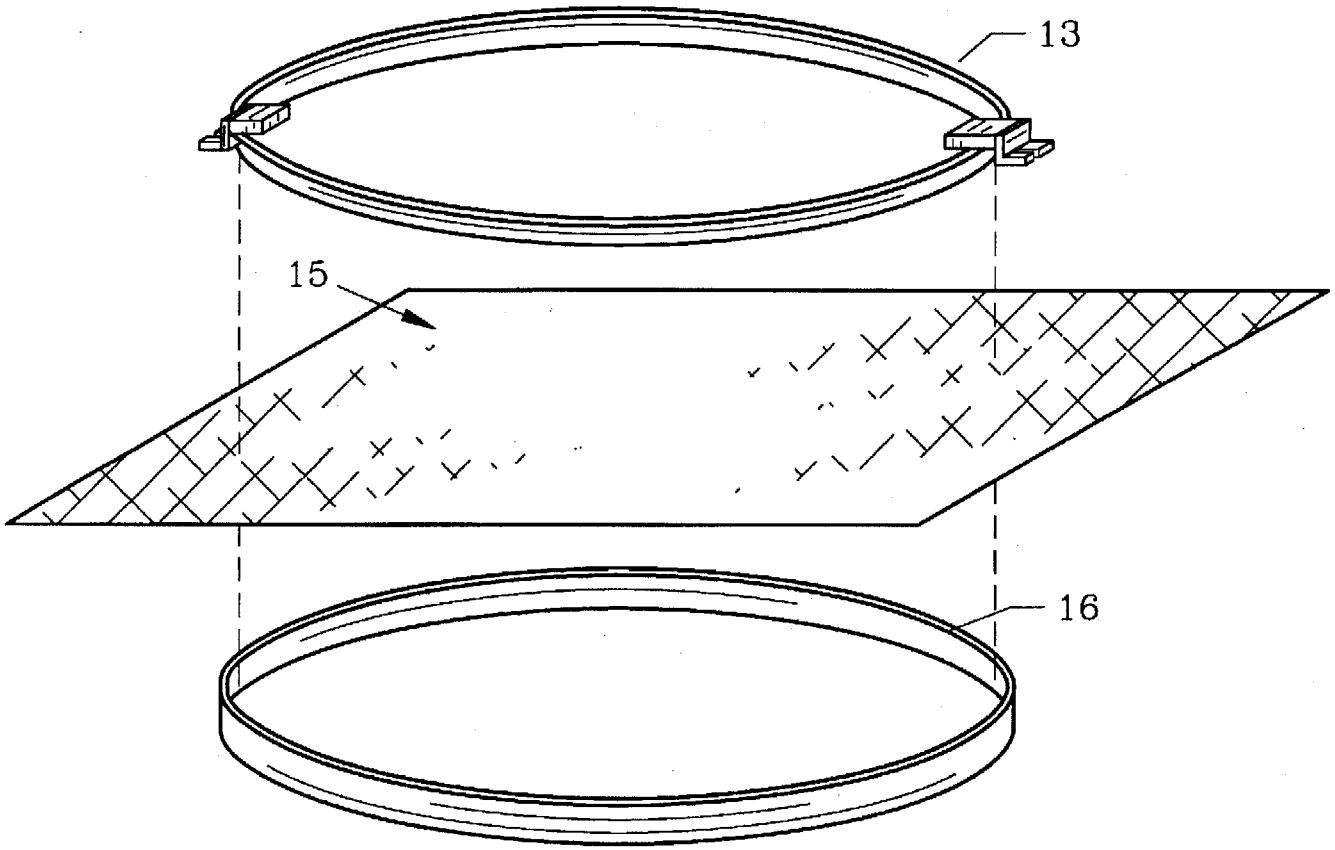
FIG. 6 features the fabric hoops and fabric as removed from the press and in disassembled form.

The preferred form of the apparatus of the invention is shown in FIGS. 1–5 whereby hoop press 10 is seen in FIG. 1 with upper platen 11 in descent toward lower platen 12. Upper platen 11, shown in cross-sectional view, contains inner fabric hoop 13 likewise shown in cross-section thereon. Fabric 15 is shown loosely placed across lower platen 12 which contains outer fabric hoop 16. Lower platen 12 and outer fabric hoop 16 are likewise shown in cross-sectional view. Handle 17, connected to upper platen 11, allows the operator to apply downward pressure to upper platen 11 to frame fabric 15 between outer fabric hoop 16 and inner fabric hoop 13. In FIG. 6, fabric hoops 13 and 16 and fabric 15 are shown removed from press 10 for clarity. As would be understood, various other shapes and forms of fabric hoops could be employed as are normally used in the industry. Fabric 15 is shown as a single ply of fabric but as would be understood, may consist of a shirt, jacket back or other fabric having one or more plies.

Figure 2:
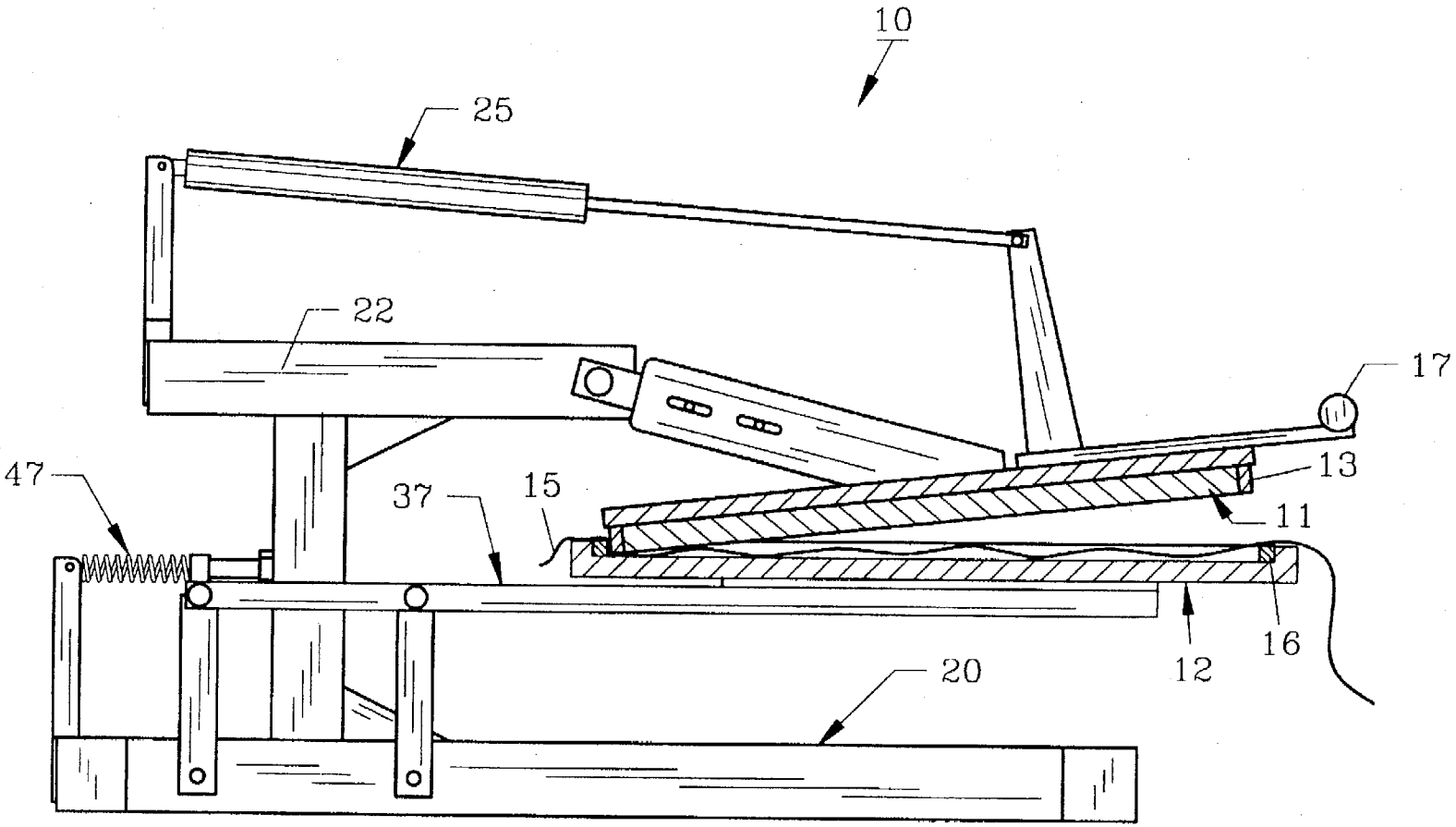
FIG. 2 demonstrates the hoop press as shown in FIG. 1 with the upper platen in a further downward state, advanced from that shown in FIG. 1.
Figure 3:
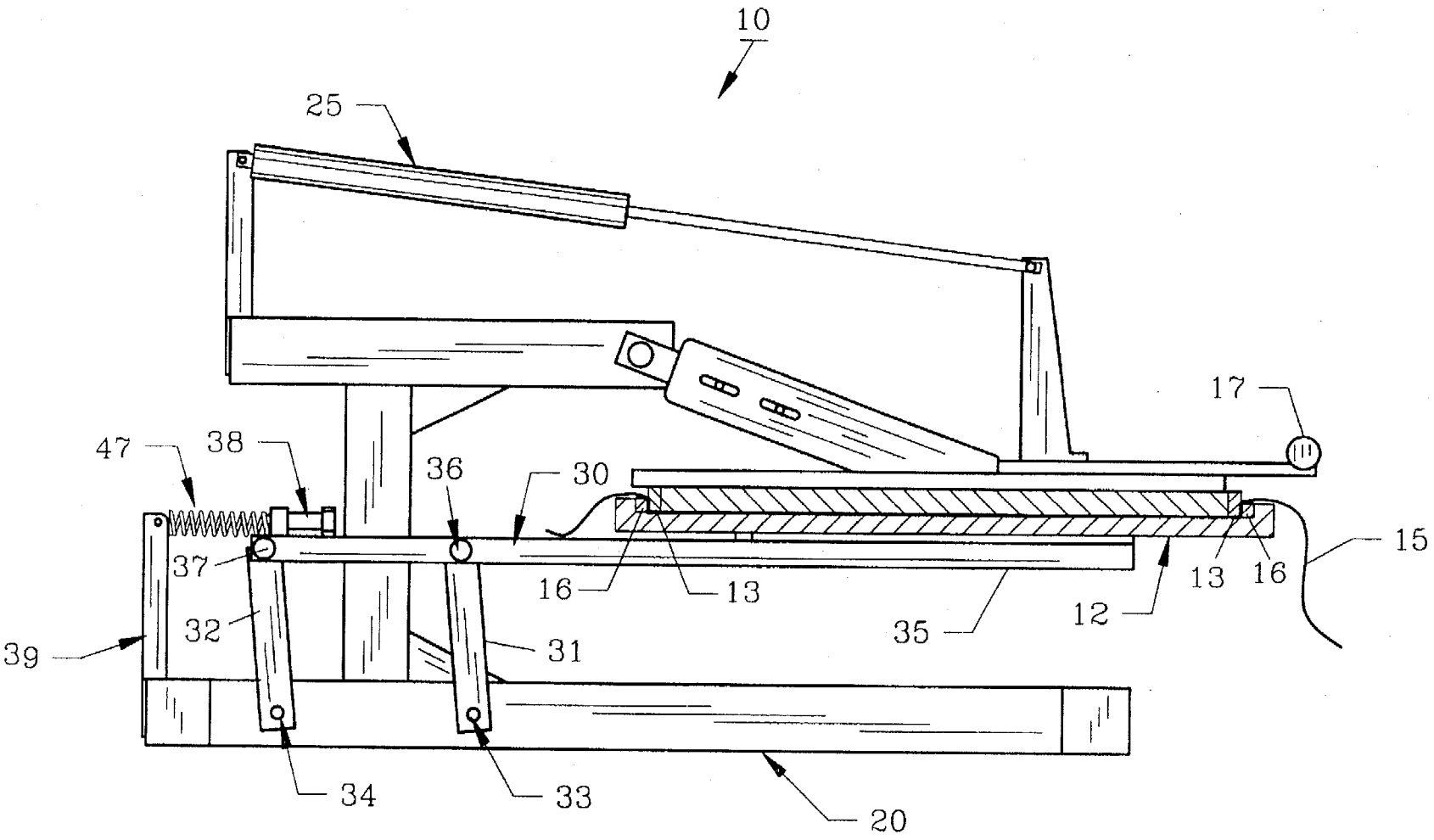
FIG. 3 illustrates the hoop press as seen in FIG. 1 with the upper platen and lower platen pivoted with the inner and outer fabric hoops fully engaged.

Press 10 as shown in FIGS. 1–3, includes a rigid base 20 formed from metal tubing which may be attached to or placed on a shelf, table or the like. Stanchion 21 is joined to base 20 and, in the preferred embodiment, is made of steel and welded thereto with triangle-shaped brackets. Affixed to the top of stanchion 21 is horizontal beam 22 which is pivotally attached to rotatable arm 23 at joint 24. Joint 24 allows upper platen 11 to pivot in an arcuate path downwardly as viewed in FIGS. 2 and 3. Dampener 25 is a conventional spring-loaded dampener which prevent high velocity upward motion of upper platen 11 should handle 17 be quickly released. Dampener 25 is pivotally joined to upper platen 11 through pivot joint 26 and upright 27. Vertical member 28 which is a rigid metal member connects dampener 25 to horizontal member 22.

In FIG. 2, upper platen 11 has moved downwardly from the position shown in FIG. 1, whereby initial angular contact is made at the rear of upper platen 11 and lower platen 12. As further seen in FIG. 2, fabric 15 is now tightly sandwiched at the rear, between inner fabric hoop 13 and outer fabric hoop 16. Lower platen 12 remains in the same position relative to base 20 as in FIG. 1 with the angle between upper platen 11 and lower platen 12 approximately 8°–10°, reduced from the approximate 15° as shown in FIG. 1.

FIG. 3 shows final, full engagement of inner fabric hoop 13 and outer fabric hoop 16, with fabric 15 fully, tightly framed therebetween. It is noted that lower platen 12, which is affixed to carriage 30, has now pivoted rearwardly, from right to left from its previous position seen in FIG. 2. This slight rearward movement facilitates the frictional insertion of inner fabric hoop 13 and fabric 15 within outer fabric hoop 16 and requires less manual pressure on handle 17. Thus, a worker can repeat the framing action frequently during an eight-hour shift without undue physical exertion or fear of developing the carpel tunnel syndrome effect.

As further shown in FIG. 3, carriage 30 is joined to base 20 by upright members 31, 32 which are pivotally connected to base 20 at respectively, points 33, 34 and to horizontal member 35 at point 36, 37. Carriage 30 is resiliently spaced from base 20 by coil spring 47 which includes threaded adjusting member 38. Vertical spring connector 39 is welded or otherwise rigidly affixed to base 20. Once inner fabric hoop 13 is fully engaged within outer fabric hoop 16 while sandwiching fabric 15 therebetween as shown in FIG. 3, handle 17 can then be released and the framed fabric removed for placement on a sewing machine for stitching or embroidering as is conventional in the trade. Thereafter, upper platen 11 and lower platen 12 are again loaded with appropriate fabric hoops and fabric and the cycle begun anew. Upper platen 11 and lower platen 12 are configured to received the specific hoops as shown thereon although other platen configurations could be utilized, for example, for round fabric hoops or other shapes needed.

In FIG. 4 a view of hoop press 10 is presented with upper platen 11 in its most downward position as shown in FIG. 3. In FIG. 5, a front elevational view of hoop press 10 opened is depicted without fabric 15 thereon. Spring-loaded lower ball retainer 50 is shown, which engages outer fabric hoop 16 as does upper ball retainer 51 shown on upper platen 11.

The preferred method of the invention utilizes hoop press 10 as shown in FIGS. 1–3 and consists of loading upper platen 11 with selected inner fabric hoop frame 13 which is maintained in place by ball retainer 51. Selected outer fabric hoop frame 16 is then loaded onto lower platen 12 and a fabric, such as fabric 15, is placed over lower platen 12 and hoop frame 16. Next, the operator pivots upper platen 11 by applying downward manual pressure to handle 17 which causes upper platen 11 to initially contact lower platen 12 at an angle of approximately 10°. With continued downward pressure on handle 17, inner fabric hoop 13 sandwiches fabric 15 and moves into continued engagement with outer fabric hoop 16 at the rear of platen 12 as shown in FIG. 2. Continued downward pressure on handle 17 causes lower platen 12 to pivot and move rearwardly as upper platen 11 simultaneously completes its pivoting action whereby inner fabric hoop 13 is brought into gradual, full engagement with outer fabric hoop 16 with fabric 15 tightly sandwiched therebetween. Handle 17 is then released and fabric 15, which is now taut and framed between inner fabric hoop 13 and lower hoop 16 is then removed with fabric hoops 13 and 16 from press 10. Press 10 can then be reloaded with new fabric hoops and fabric and the fabric framing cycle repeated.

The examples and illustrations presented are merely for illustrative purposes of the preferred embodiment and other changes and modifications can be made by those skilled in the art without departing from the scope of the appended claims.

I claim:

1. A hoop press comprising: a frame, an upper hoop platen, a lower hoop platen, said upper hoop platen pivotally joined to said frame, said lower hoop platen pivotally movable along said frame whereby said upper hoop platen is engageable with said lower hoop platen.

2. The hoop press of claim 1 further comprising a dampener, said dampener attached to said upper hoop platen.

3. The hoop press of claim 1 further comprising a resilient member, said resilient member attached to said lower hoop platen.

4. The hoop press of claim 3 further comprising a means to adjust said resilient member, said adjusting means attached to said frame.

5. A hoop press comprising: a frame, said frame comprising a base, a lower hoop platen, said lower hoop platen pivotally joined to said base, a stanchion, said stanchion attached to said base, an upper hoop platen, said upper hoop platen pivotally joined to said stanchion whereby said upper hoop platen is pivotable downwardly into initial engagement with said lower hoop platen and upon further downward motion of said upper hoop platen, said upper hoop platen and said lower hoop platen pivot into full engagement.

6. The hoop press of claim 5 further comprising a dampener, said dampener attached to said upper hoop platen.

7. The hoop press of claim 5 further comprising a resilient member, said resilient member attached to said lower hoop platen.

8. The hoop press of claim 5 wherein said upper hoop platen is configured to receive an inner fabric hoop.

9. The hoop press of claim 5 wherein said lower hoop platen is configured to receive an outer fabric hoop.

10. A method of framing cloth with a hoop press comprising the steps of:

(a) loading the press with an inner and outer fabric hoop;

(b) placing fabric over the outer fabric hoop;

(c) pivoting the inner fabric hoop into angular engagement with the outer fabric hoop and fabric;

(d) pivoting the inner fabric hoop into full engagement with the outer fabric hoop as the outer fabric hoop simultaneously pivots to thereby frame the fabric.

11. The method of claim 10 further comprising the step of removing the framed fabric from the press.

12. The method of claim 10 wherein loading the press comprises the step of attaching an upper hoop platen and a lower hoop platen.

13. The method of claim 10 wherein placing fabric over the outer fabric hoop comprises the step of placing a garment section over the outer fabric hoop.

14. The method of claim 10 wherein pivoting the inner fabric hoop into initial angular engagement comprises the step of pivoting the inner fabric hoop into angular initial engagement of about 30°.

15. The method of claim 10 wherein pivoting the inner fabric hoop into initial engagement comprises the step of pivoting the inner fabric hoop continuously into coincidental engagement with said outer fabric hoop.

* * * * *